US010443993B1

(12) United States Patent
Chaplin et al.

(10) Patent No.: US 10,443,993 B1
(45) Date of Patent: Oct. 15, 2019

(54) SPIN DISCARDING MULTIPLE PROJECTILE SABOT

(71) Applicant: U.S. Government as Represented by the Secretary of the Army, Picatinny Arsenal, Dover, NJ (US)

(72) Inventors: Raymond Chaplin, Hopatcong, NJ (US); Christopher C. Parisi, Lake Hopatcong, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/203,706

(22) Filed: Nov. 29, 2018

(51) Int. Cl.
*F42B 14/06* (2006.01)
*F42B 12/06* (2006.01)

(52) U.S. Cl.
CPC ..... *F42B 14/064* (2013.01); *F42B 14/065* (2013.01); *F42B 12/06* (2013.01)

(58) Field of Classification Search
CPC ..... F42B 14/064; F42B 14/065; F42B 12/06
See application file for complete search history.

(56) References Cited

U.S. PATENT DOCUMENTS 3,905,299 A * 9/1975 Feldmann ..... F42B 14/064 102/522
4,296,687 A * 10/1981 Garrett ..... F42B 14/064 102/518
4,516,502 A * 5/1985 Klein ..... F42B 5/03 102/489
4,709,638 A * 12/1987 Broden ..... F42B 14/068 102/522
4,881,466 A * 11/1989 McGinley ..... F42B 14/064 102/522
4,920,887 A * 5/1990 Frehaut ..... F42B 12/62 102/357
5,003,886 A * 4/1991 Pahnke ..... F42B 10/38 102/501
6,129,024 A * 10/2000 Gerber ..... F42B 12/28 102/521
7,549,376 B1 * 6/2009 Grossman ..... F42B 10/50 102/400
8,333,153 B2 * 12/2012 Caillat ..... F42B 14/064 102/520
9,046,332 B2 * 6/2015 Peterson ..... F42B 7/08
9,188,417 B2 * 11/2015 Geswender ..... F42B 14/06
9,329,008 B1 * 5/2016 Gilbert ..... F42B 10/48

* cited by examiner

*Primary Examiner* — Joshua T Semick
(74) *Attorney, Agent, or Firm* — John P. DiScala

(57) ABSTRACT

An ammunition round for simultaneously launching multiple penetrators enclosed with a single composite sabot, without any nesting or physical contact between the penetrators. The composite sabot has petals which are engraved by the tube's rifling during launch to rotate the petals, without presence of a separate rotating band element. The petals are separated from the penetrator elements upon exit from the gun tube solely by centrifugal forces acting on the petals.

8 Claims, 5 Drawing Sheets

SPIN DISCARDING MULTIPLE PROJECTILE SABOT

U.S. GOVERNMENT INTEREST

The inventions described herein may be made, used, or licensed by or for the U.S. Government for U.S. Government purposes.

BACKGROUND OF INVENTION

Military units often have the need to fire projectiles at high velocities to defeat certain targets. One method of obtaining the high velocities required in these instances has been to use a sub-caliber projectile inside a sabot within a barrel for launching, while ensuring that gas pressure from burning propellant is sealed inside the barrel. The use of a sabot has been in practice since the invention of the firearm. However, many modern sabot designs involve components that fracture during projectile launch to complete the discarding process. Modern sabots are also designed to contain only one penetrator.

An example of a saboted round might be the M903 Saboted Light Armor Penetrator (SLAP) cartridge currently manufactured by Olin-Winchester. That round relies on centrifugal forces and a crush-condition during engraving to shatter the sabot at muzzle exit to initiate discard. During sabot fragmentation, impulse can be transferred to the penetrator causing system accuracy to suffer. It is not capable of launching multiple projectiles without nesting or interaction between the individual components.

Another example of a saboted round is a three-petal sabot design that utilizes a slip ring to decouple the sabot from the gun barrel rifling. This type of sabot is designed to launch fin-stabilized rounds and relies on fracture of the slip ring to initiate discard. The discarding process of that type of sabot can also cause system accuracy to suffer. It also cannot launch multiple projectiles.

A yet further example of a saboted round is a spin-stabilized discarding-sabot projectile. This type of sabot makes use of a metallic pusher combined with a plurality of plastic petals with extended slots or weakening lines. Once again, this type of sabot relies on fracture of sabot hardware to initiate discard, affecting system accuracy. If multiple penetrators were desired, that design would still need to make use of nesting or interaction between the penetrators, hurting accuracy.

BRIEF DESCRIPTION OF THE INVENTION

The present invention incorporates a sabot with a plurality of petals connected to a pusher plate via an interlocking keyway feature. The invention is designed so it can simultaneously launch one or multiple sub-caliber penetrators, if desired. Importantly to not lose impulse energy, or to transfer impulse energy to the projectiles during launch, the invention's petals and pushers do not require being fractured in order to function, and are especially designed to not fracture, during the gun launch event. Discarding of the sabot petals is accomplished by centrifugal forces on the sabot-penetrator assembly upon muzzle exit. An important goal of this round is to develop an accurate multiplex round to increase probability of hit at long ranges. It can be useful in intercepting drones, UAV's, at longer ranges (before they get closer) using small arms weapons/rounds, and where multiple spin stabilized projectiles might be fired with only one propelling charge in a small arms weapon.

OBJECTS OF THE INVENTION

Accordingly, it is an object of the present invention to provide a saboted ammunition round with a plurality of sabot petals connected to a pusher plate via a keyway feature.

Another object of the present invention is to provide a saboted ammunition round with petals and pusher plates that can survive the gun launch environment without fracturing.

It is a further object of the present invention to provide a saboted ammunition round which can discard its sabot petals simply by using centrifugal force after muzzle exit.

It is yet another object of the present invention to provide a saboted ammunition round able to simultaneously launch one or multiple sub caliber spin stabilized penetrators.

These and other objects, features and advantages of the invention will become more apparent in view of the within detailed descriptions of the invention, the claims, and in light of the following drawings and tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF THE DRAWINGS

DETAILED DESCRIPTION OF THE INVENTION

Figure 1:
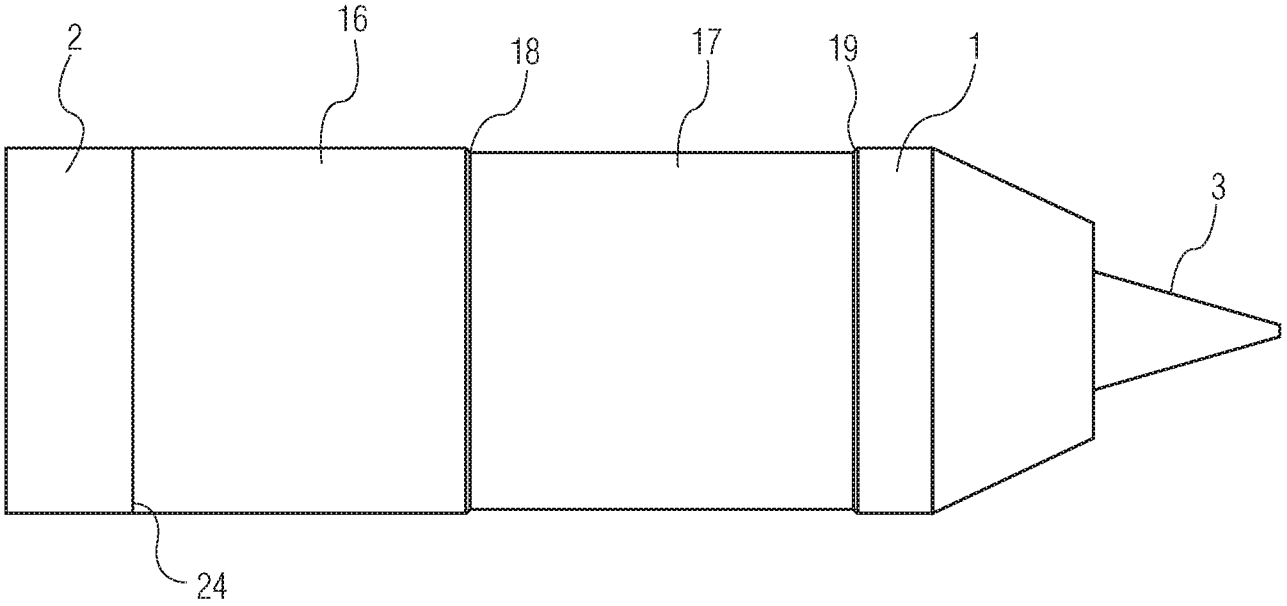
FIG. 1 is a view showing an assembled sabot penetrator according to this invention before loading into a cartridge case.
Figure 2:
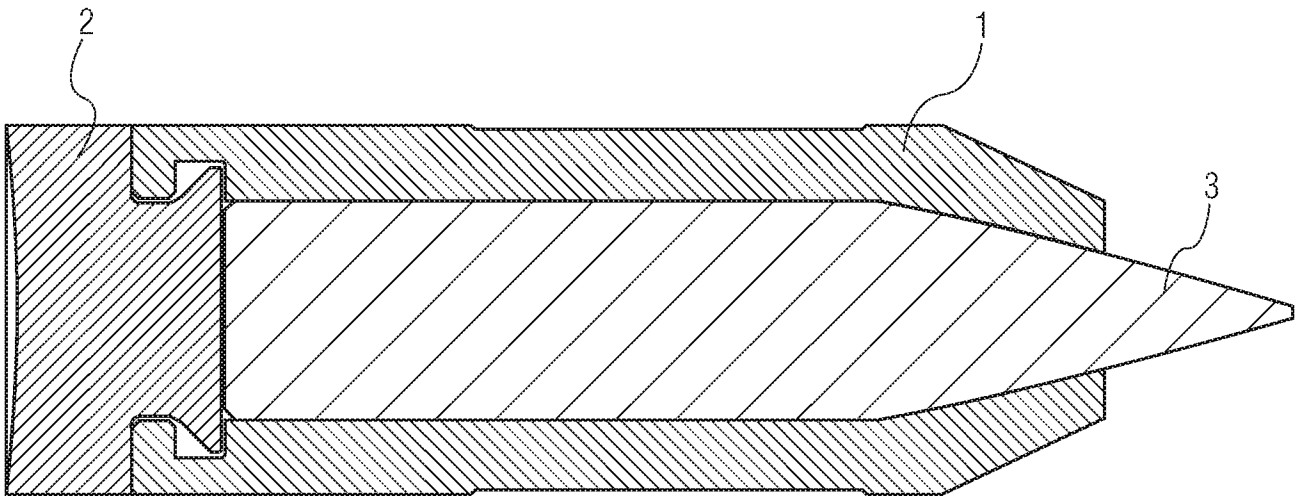
FIG. 2 is section view of a single penetrator configuration according to this invention.
Figure 3:
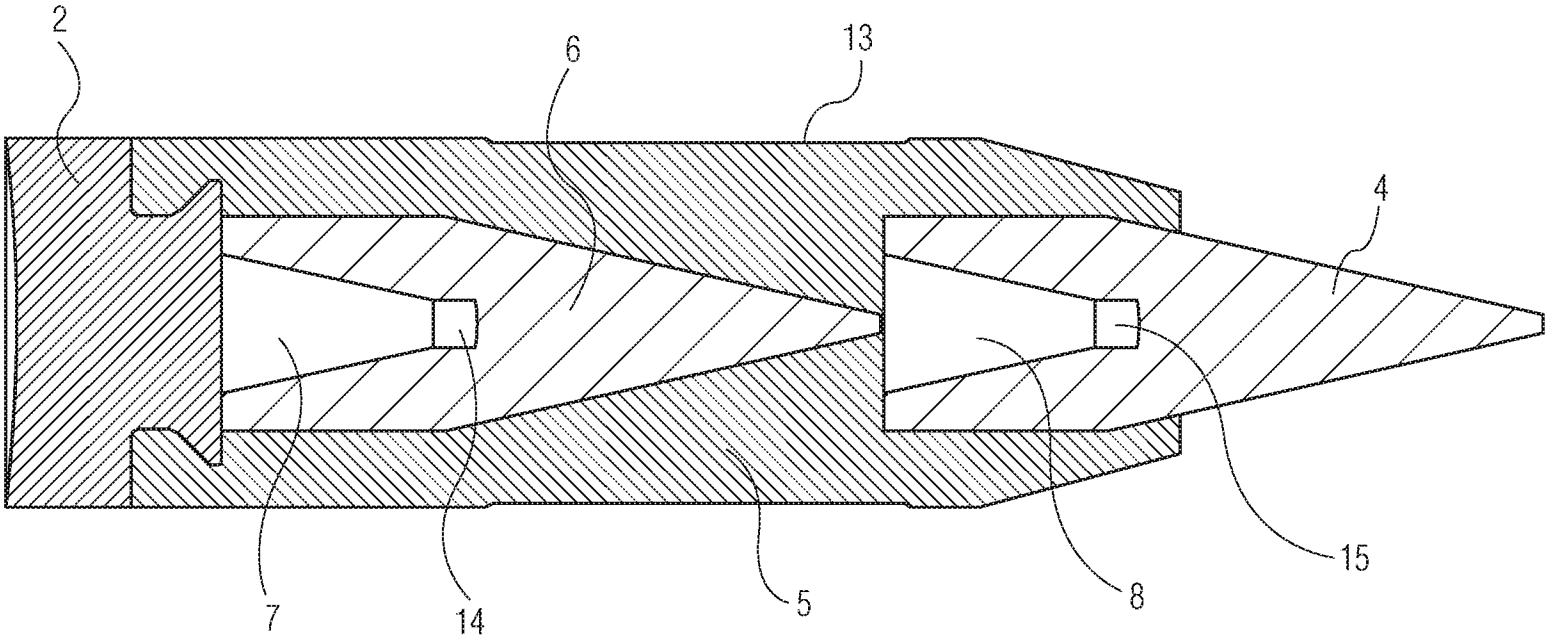
FIG. 3 is a section view of a multiple penetrator configuration according to this invention illustrating how the sabot design may be modified to fire multiple spin stabilized projectiles.
Figure 4:
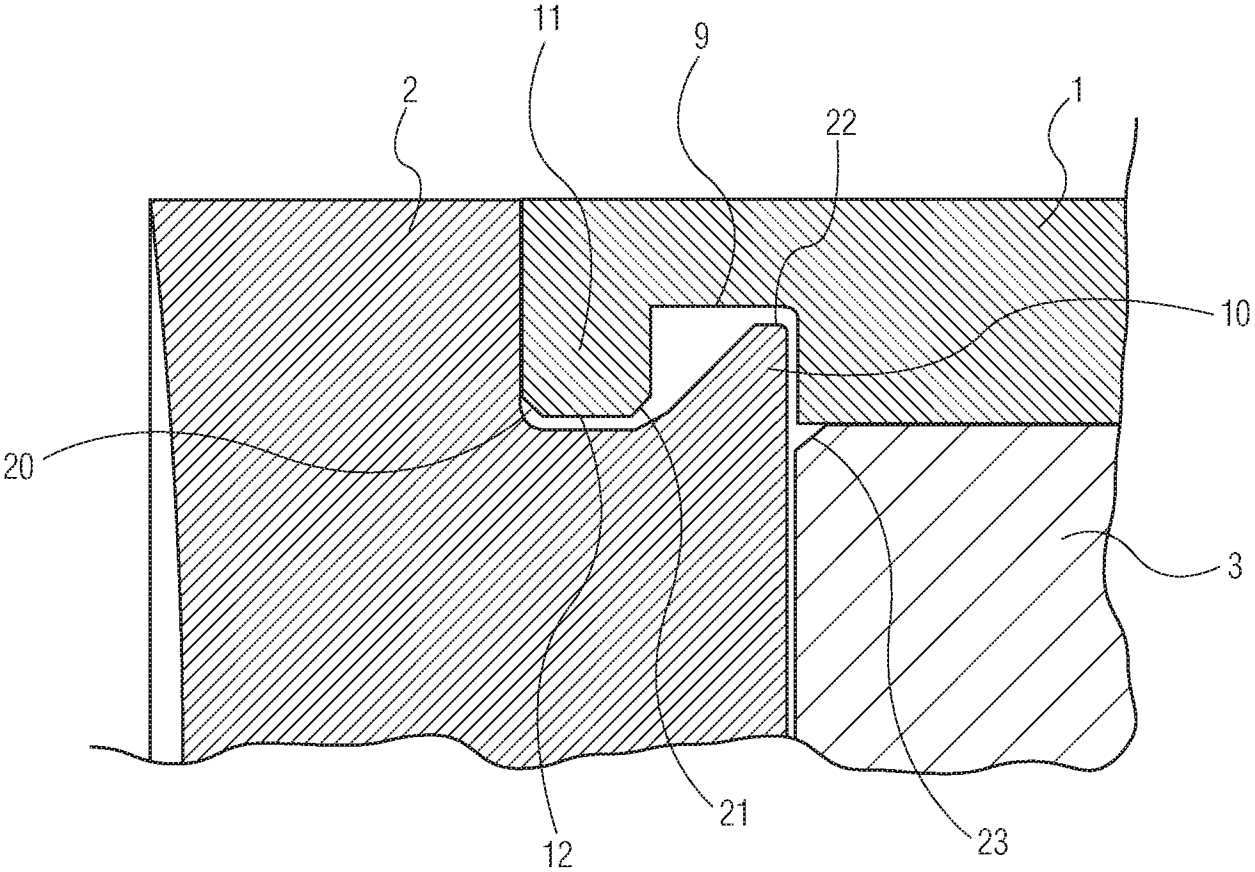
FIG. 4 is a close up section view of the keyway feature according to this invention which shows how the sabot petals may connect with the pusher plate and drive the penetrator during gun launch.
Figure 5:
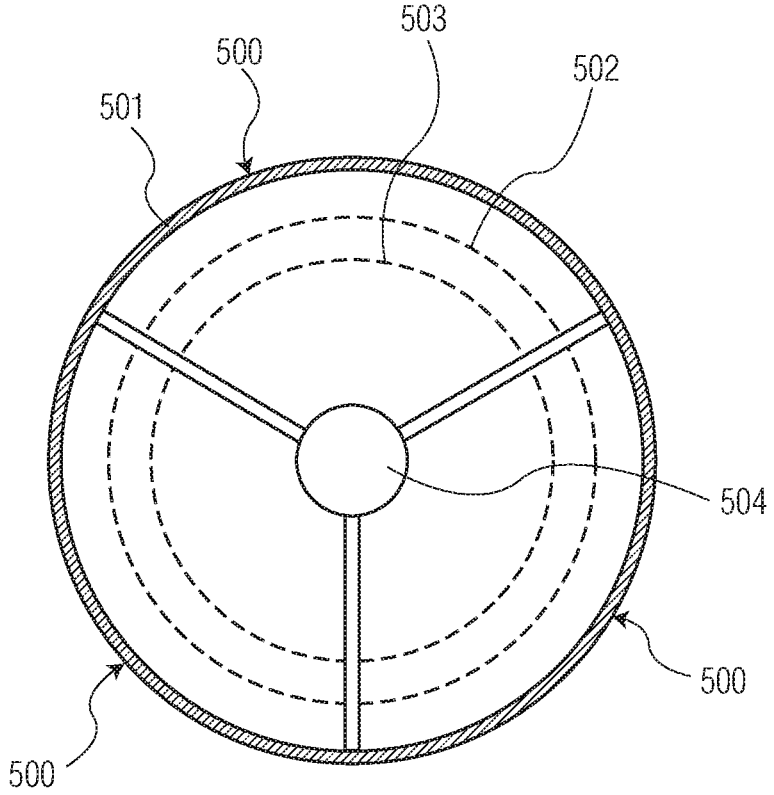
FIG. 5 shows cross sectional view of three symmetric sections of a possible petal design, with a central open area to enclose a respective penetrator.

FIG. 1 is a view showing an assembled sabot penetrator before loading into a cartridge case. It contains multiple sabot petals 1, a rear pusher plate 2, and a projectile 3. FIG. 2 is section view of a single penetrator configuration. This shows the cross section of the petal 1, pusher 2, and penetrator 3. FIG. 3 is a section view of a multiple penetrator configuration. This shows how the sabot design may be modified to simultaneously fire multiple spin stabilized projectiles. It contains petals 5, 13, with spacers to avoid nesting of the multiple penetrators 4, 6. The petals are connected via the keyway feature to the pusher plate 2. Within penetrator 6 there is space for a warhead 7 with fuzing 14; within penetrator 4 there is space for a shape charge warhead 8 with fuzing 15. Warheads 7, 8 might comprise shape charge type warheads, e.g. FIG. 4 is a close up section view of the keyway feature. This shows how the petals 1 connect with the pusher plate 2 and how the pusher plate drives the penetrator 3 during a gun launch. The invention is comprised of a sabot designed to launch a single or multiple concentric spin stabilized projectiles with one propelling charge. To accomplish this, either one 3 or multiple 4, 6, e.g., penetrators are placed within a plethora of sabot petals 1 or 5, 13, e.g. The petals cross sectionally are comprised of three symmetric sections 500 (see FIG. 5 in conjunction with FIG. 2, e.g.) with a central open area 504 (the diameter and shape of which central open area will necessarily vary radially along the petal longitudinal axis) sized to snugly enclose a respective penetrator. The inner diameter of the petal is 503, the radial slot extends to 502, and the outer diameter (which varies radially down the petal's longitudinal axis) is 501. It is possible to have a different number than three, for the petal symmetric sections, any number, one, two or greater is theoretically feasible. The sabot petals are constrained in the direction of the barrel axis longitudinally via the interaction between the pusher plate 2 via the keyway feature shown in FIG. 4. After assembly the sabot round is inserted in a cartridge case, see 16-19 and 24 in FIG. 1, e.g., which constrains the bullet radially. This invention's petals and pushers are designed to not fracture during the gun launch event. Discarding of the sabot petals is accomplished by centrifugal forces on the sabot-penetrator assembly upon muzzle exit. This projectile ensures that gas pressure from burning propellant is sealed inside the barrel. The spin discarding multiple projectile sabot utilizes a sabot with multiple petals and pusher plate that is designed to fire multiple spin stabilized sub-caliber projectiles. The petals and plate are interlocked through the employment of a keyway feature. The pusher plate has side annular slot 12 and the petal has side annular slot 9 into which are respectively fitted, an annular post type section 11 on the petal 1, and an annular post type section 10 on the pusher 2. The pusher plate, petals and penetrators have chamfered edges (20, 21, 22). This integral design feature allows for centrifugal forces to discard the sabot petals after the sabot-penetrator assembly exits the barrel. The petals and pusher can be made of most any material which will not fracture during the gun launch event yet will engrave properly. Some examples of materials may include plastics, composites, brass, copper, aluminum, lead or steel. By altering the interior shape of the petals, the sabot allows for the use of single or multiple penetrators to be fired at once. It is capable of launching multiple projectiles without nesting or interaction between the individual projectiles. And as was mentioned, the present invention is designed to withstand the high pressures of a gun launch environment without fracture of the sabot components. Again, the petals and pusher of said sabot are designed to be interlocked together via a keyway feature that allows the petals to discard radially upon muzzle exit. Prior to the firing event, the sabot petals are held onto the projectile and pusher via crimping of the round as a cartridge case, see 16-19 and 24 in FIG. 1, e.g. The sabot can allow for one or multiple penetrators by adjusting the internal dimensions of the sabot petals as needed. And, discarding of the sabot petals is accomplished solely by centrifugal forces on the sabot-penetrator assembly upon muzzle exit.

After the propelling charge is ignited, the round travels forward with the sabot petals engaging on the rifling. The rifling imparts spin onto the sabot petals, which in turn imparts spin onto the penetrators. During engraving, the sabot petals are constrained radially by the gun barrel until the round exits the muzzle at which point spinning action will discard the sabot petals allowing the penetrators to travel at their intended target.

While the invention may have been described with reference to certain embodiments, numerous changes, alterations and modifications to the described embodiments are possible without departing from the spirit and scope of the invention as defined in the appended claims, and equivalents thereof.

What is claimed is:

1. An ammunition round comprising:

multiple concentric subcaliber penetrator elements (4, 6) for simultaneous launching in a rifled gun tube, a rear pusher plate (2) for imparting axial impetus to said penetrator elements during launch, said pusher plate having an aft shaped as convex in the forward looking direction, a spin discarding composite sabot system enclosing the penetrator elements, said sabot system comprising petals (5, 13) having slots (9) and posts (11) so said petals are keyed to one another and to said rear pusher plate, and wherein the penetrator elements are not nested or mutually touching, and wherein the penetrator elements, pusher plate and petals are not permanently joined, wherein the petals are engraved by the tube's rifling during launch which rotates the petals and the penetrator elements, the engraving being done without presence of a separate rotating band element on the ammunition round to accomplish such rotations, and wherein the petals are separated from the penetrator elements upon exit from the gun tube by centrifugal forces alone acting on the petals.

2. The ammunition round of claim 1, wherein the penetrator elements (4, 6) are contained within the petals (5) and (13) respectively.

3. The ammunition round of claim 2, wherein each penetrator element contains a warhead with fuzing.

4. The ammunition round of claim 3, wherein the warhead is a shape charge.

5. The ammunition round of claim 1, wherein each of the petals of the sabot system have a cross section which is symmetric about a central open area containing the penetrator elements.

6. The ammunition round of claim 5, wherein the number of petals is three.

7. The ammunition round of claim 1, wherein the sabot petals are held onto the penetrator elements and pusher plate via crimping by a cartridge case (16, 17, 18, 19, 24) prior to firing the round.

8. The ammunition round of claim 1, wherein the pusher plate, petals and penetrators have chamfered edges (20, 21, 22).

* * * * *